United States Patent [19]

Berger

[11] 4,423,744

[45] Jan. 3, 1984

[54] TOBACCO SMOKE FILTER CONTOURED TO PROVIDE UNDILUTED AIR FLOW AND METHOD AND APPARATUS FOR MANUFACTURING SAME

[75] Inventor: Richard M. Berger, Midlothian, Va.

[73] Assignee: American Filtrona Corporation, Richmond, Va.

[21] Appl. No.: 333,802

[22] Filed: Dec. 23, 1981

[51] Int. Cl.[3] ..... A24D 3/00; A24D 3/04

[52] U.S. Cl. ..... 131/336; 131/198 R; 131/361; 131/362; 131/339

[58] Field of Search ..... 131/336, 198 R, 198 A, 131/361, 362, 339

[56] References Cited

U.S. PATENT DOCUMENTS

| | | | |
|---|---|---|---|
| 3,324,862 | 6/1967 | De Simone | 131/336 |
| 3,490,461 | 1/1970 | Osmalov et al. | 131/336 |
| 3,596,663 | 8/1971 | Schultz | 131/336 |
| 3,608,561 | 9/1971 | Dock | 131/336 |
| 3,752,165 | 8/1973 | Harllee et al. | 131/339 |
| 3,773,883 | 11/1973 | Labbe et al. | 264/151 |
| 4,082,098 | 4/1978 | Owens, Jr. | 131/274 |
| 4,135,523 | 1/1979 | Luke et al. | 131/336 |
| 4,213,470 | 7/1980 | Horsewell et al. | 131/339 |
| 4,256,122 | 3/1981 | Johnson | 131/336 |

FOREIGN PATENT DOCUMENTS

| | | | |
|---|---|---|---|
| 1308661 | 2/1973 | United Kingdom | 131/336 |
| 1414745 | 11/1975 | United Kingdom | 131/336 |
| 2012554 | 8/1979 | United Kingdom | 131/336 |

*Primary Examiner*—V. Millin
*Assistant Examiner*—Harry J. Macey
*Attorney, Agent, or Firm*—Holman & Stern

[57] ABSTRACT

An improved tobacco smoke filter is characterized by an undiluted air passage formed between a smoke-impervious plug wrap and an air-impervious tipping wrap by loosely wrapping the tipping wrap about the plug wrap along a section of the filter extending from its smoke discharge end. In a preferred embodiment, the loose wrapping is effected by reducing the cross-sectional perimeter of the rod and plug wrap along the aforesaid section while keeping the tip of the cross-sectional perimeter substantially constant throughout its length. A raised lip is provided at the smoke discharging end of the rod and plug wrap to define a cigarette holder in the filter. For circumstances where the cross-section of the filter plug becomes too complex for adherence of the tipping paper, heat shrinkable film can be laminated in the tipping paper so that after the entire cigarette is assembled, it can be subjected to heat and cause the tipping paper to shrink to the appropriate size. In addition, particles of material which impart flavor to the smoke may be embedded into the plug wrap. Apparatus and method for manufacturing the filter as described are disclosed.

22 Claims, 15 Drawing Figures

FIG. 1
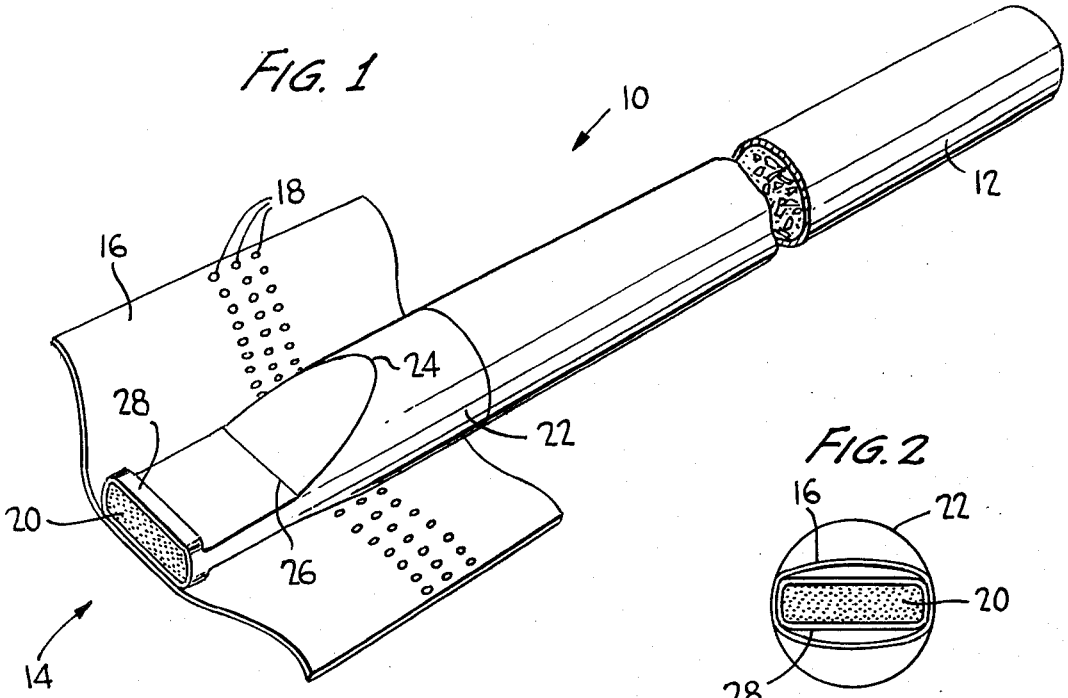
FIG. 2
FIG. 3
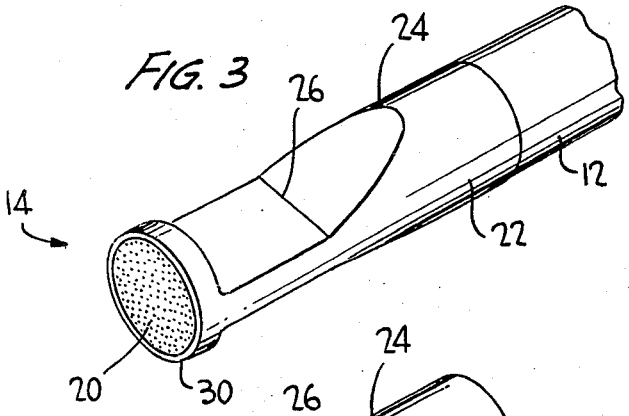
FIG. 4
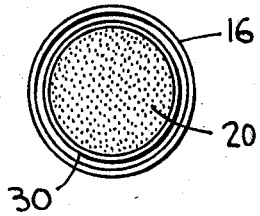
FIG. 7
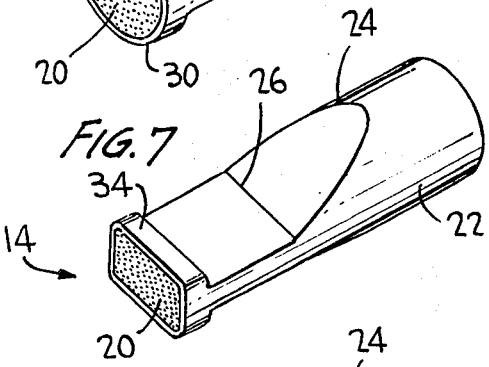
FIG. 8
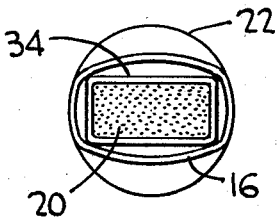
FIG. 5
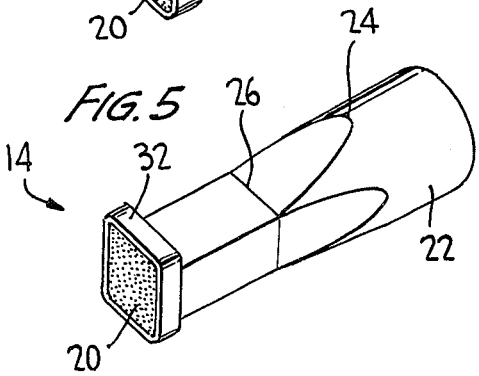
FIG. 6
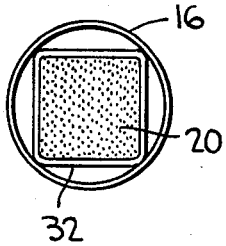

TOBACCO SMOKE FILTER CONTOURED TO PROVIDE UNDILUTED AIR FLOW AND METHOD AND APPARATUS FOR MANUFACTURING SAME

TECHNICAL FIELD

The present invention relates to filter elements and the fabrication of such filter elements. More particularly, the present invention is primarily concerned with producing filter means for cigarettes, all of the products of this invention are generally useful as filters, particularly for tobacco smoking means, whether they be cigarettes, cigars, pipes or the like. Since filters for cigarettes are particularly important commercially, the basic embodiment of the present invention is described as it relates to the production of filtered cigarettes.

BACKGROUND OF THE INVENTION

In manufacturing filters for use in connection with cigarettes and the like, a number of different properties of the resultant filter are taken into consideration. While filtration efficiency (i.e., the ability of the filter to remove undesirable constituents from tobacco smoke) is perhaps the most important property of cigarette filters, filtration efficiency must frequently be compromised in order for the filter to possess a commercially acceptable combination of other properties, including pressure drop, taste, hardness, appearance, and cost. For example, the most commonly utilized cellulose acetate filter has a relatively low filtration efficiency since increased efficiency can only be obtained either by increasing the density of the filter material or the length of the filter element, both of which produce a pressure drop across the filter which is excessive and unacceptable from a commercial standpoint.

In recent years, air dilution has become a popular technique for compensating for the relatively low filtration efficiency of cigarette filters having a sufficiently low pressure drop for commercial acceptance. The air dilution technique employs ventilating air to dilute the smoke stream from the cigarette and thereby reduce the quantity of tar and other undesirable tobacco smoke constituents drawn into the smoker's mouth for each puff or draw. The ventilating air is generally provided through a plurality of perforations in the tipping paper which joins the filter to the tobacco column of the cigarette, and if the filter is overwrapped with plug wrap paper, an air pervious plug wrap paper is employed. Generally, as described in my co-pending U.S. patent application Ser. No. 261,690, filed May 07, 1981, the ventilating passage is defined as a groove formed in the periphery of the filter rod and plug wrap material. The groove may extend longitudinally of the rod or may be defined in some tortuous path in the rod periphery. In any case, the air-impervious tipping paper serves as a seal for the ventilating air path thusly defined, except for ventilating holes formed in the tipping paper which serve as an air ingress for the air path.

The air dilution technique has several advantages in that it is a most economical method of reducing tar, it enables achievement of the exact amount of tar delivery desired, and it also contributes to the removal of undesirable gas phase constituents, such as carbon monoxide and nitric oxide. A major disadvantage of the air dilution technique includes lack of taste. In fact, since the introduction of air-diluted cigarettes, manufacturers have gone to great lengths of enhance the taste and/or control the tar delivery of cigarettes.

A different, but related consideration of the present invention, concerns cigarette holders. Cigarette holders were devised for the purpose of providing to the smoker a mouthpiece that fits the smoker's lips. Numerous cigarette holders are presently on the market but they have not been widely accepted because of any one of a number of reasons. For example, they are somewhat expensive. In addition, commercially available cigarette holders are awkward for the smoker to transport around with him or her. Equally important is the fact that these cigarette holders are designed to be used over and over and therefore require cleaning; in addition, the taste of the smoke is adversely affected by re-use of a filter.

SUMMARY OF THE INVENTION

It is an object of the present invention to provide a tobacco smoke filter in which undiluted air can be delivered to the smoker's mouth via a filter construction which is simple and inexpensive to manufacture. It is another object of the present invention to provide a tobacco smoker filter construction in which the smoke passage and air passage are maintained mutually exclusive and are mutually configured to optimize the taste of the tobacco smoke. It is still another object of the present invention to provide a tobacco smoke filter which is contoured to fit the smoker's lips and thereby serve as a cigarette holder while performing the normal functions of a smoke filter. Still another object of the present invention is to provide a tobacco smoke filter which serves as a cigarette holder and also permits efficienct delivery of undiluted air into the smoker's mouth.

In accordance with the present invention, a tobacco smoke filter comprises a rod of filter material which is wrapped with a smoke-impervious plug wrap. Tipping paper which circumscribes the plug wrap is wrapped closely about the plug wrap at the smoke receiving end of the rod but loosely around the plug wrap at the smoke discharging end of the rod. Ventilation holes defined through the tipping paper upstream of the smoke discharging end permit entry of air into the space between the plug wrap and the loosely wrapped portion of the tipping paper. In the preferred embodiment of the invention, the rod and plug wrap have a smaller cross-sectional perimeter proximate the smoke discharging end of the rod so that the tipping paper can be maintained at a constant cross-sectional diameter through out its axial length and be loosely wrapped about the smoke discharging end. Preferably, the rod and the plug wrap are configured to have a raised or enlarged lip at the smoke discharging end to fit a smoker's lips in the manner of a cigarette holder, the lip perimeter being, in any case, smaller than the perimeter of the rod and plug wrap at the smoke receiving end.

Contouring of the rod and plug wrap may be achieved by crimping the rod as desired after the plug wrap has been applied. Alternatively, the rod may be suitably crimped before application of the plug wrap which may then be extruded over the rod in the form of a film which conforms to the already crimped rod.

Various embodiments are disclosed wherein the cross-section of the rod tapers to form different configurations whereby undiluted air passages are defined between the plug wrap and the tipping paper.

BRIEF DESCRIPTION OF THE DRAWINGS

The above and still further objects, features, and advantages of the present invention will become apparent upon consideration of the following detailed description of the specific embodiments thereof, especially when taken in conjunction with the accompanying drawings, wherein:

FIG. 1 is an enlarged perspective of one form of cigarette and cigarette filter produced in accordance with the present invention, the tipping paper being partially torn away for illustrative clarity;

FIG. 2 is an end view of the smoke discharging end of the filter of FIG. 1;

FIG. 3 is a view in perspective of another filter in accordance with the present invention;

FIG. 4 is an end view of the filter of FIG. 3;

FIG. 5 is a view in perspective of another filter in accordance with the present invention;

FIG. 6 is an end view of the filter of FIG. 5;

FIG. 7 is a view in perspective of still another filter in accordance with the present invention;

FIG. 8 is an end view of the filter of FIG. 7;

DESCRIPTION OF THE PREFERRED EMBODIMENTS

Figure 9:
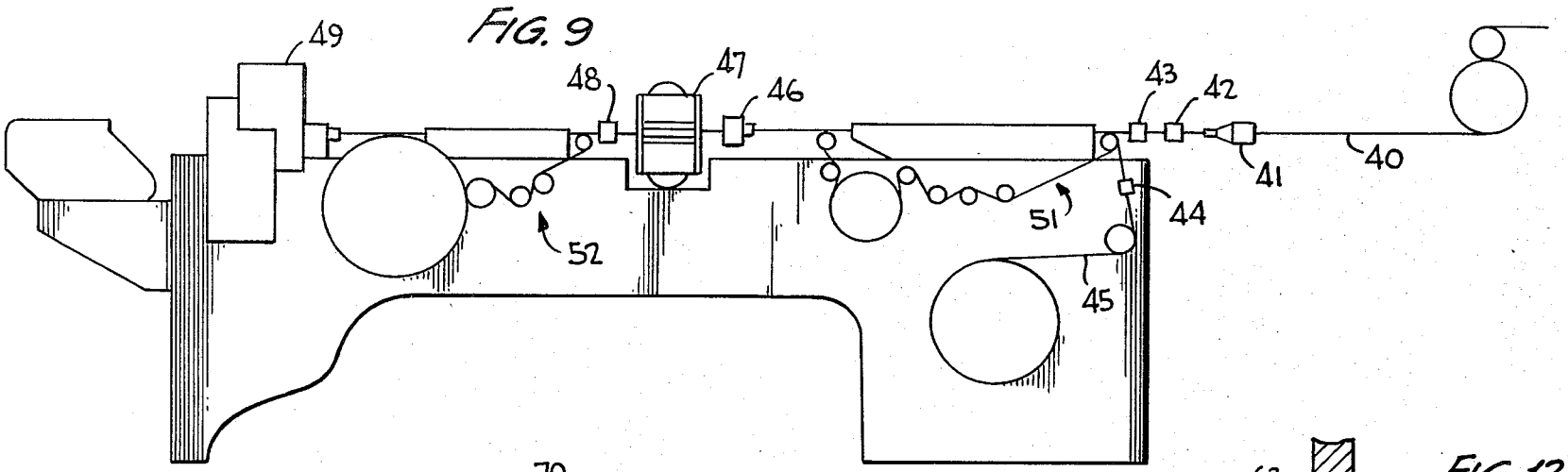
FIG. 9 is a schematic illustration of a method and means for making filter elements in accordance with the present invention.

Referring to the drawings with greater specificity, and particularly to FIGS. 1 and 2, a filtered cigarette according to the present invention is designated generally by the reference numeral 10. Cigarette 10 includes a tobacco rod 12 and a filter element 14 constructed in accordance with one embodiment of the present invention. A tipping overwrap 16 secures the tobacco rod 12 and filter element 14 in end-to-end relationship in accordance with well known techniques in this field. The tipping paper overwrap 16 is provided with plural air dilution perforations 18 arranged circumferentially about filter element 14 to permit ventilating air to be drawn through the otherwise air-impervious tipping paper with each draw or puff of the cigarette. Filter 14 includes a plug 20 made of conventional tobacco smoke filter material and typically is made from a continuous tow of cellulose acetate filamentary material; it should be noted, however, that other filtering materials could be employed with slight modifications. For example, filamentary tow formed of other materials such as polyethylene, polypropylene, and the like, or even non-woven staple filbers may be used. It should be understood, however, that cellulose acetate filamentary tow is the preferred material from a commercial standpoint. In this sense, plug 20 is fabricated from conventional materials to function as a smoke-pervious filter plug for trapping solid particulates from the smoke passing therethrough.

Plug 20 is circumscribed along its entire length by a non-porous or smoke-impervious plug wrap 22. It will be recognized by those familiar with the art that a smoke-impervious plug wrap includes smoke-impervious outer surfaces of foamed material which is integral with the filter plug as well as smoke-impervious wrapping material which is not integral with the plug. Two (2) methods, and apparatus for performing these methods, are disclosed hereinbelow.

Plug 20 has a smoke receiving end which abuts the tobacco rod 12 and a smoke discharging end constituting the distal end with respect to the tobacco rod. The plug 20 has a generally circular cross-section at the smoke receiving end and for a short distance downstream thereof. Thereafter, the plug cross-section begins to taper in both length and width in a downstream direction until a rectangular cross-section is achieved. Thus, from axial location 24, where the taper begins, to a location 26 further downstream where the taper ends, the cross-section of the filter plug 20 varies with the plug length. Downstream of location 26 the plug retains its rectangular cross-section until reaching a lip 28 formed at the smoke discharging end of the plug by increasing at least one of the cross-sectional dimensions abruptly. In the embodiment illustrated in FIGS. 1 and 2, the cross-sectional configuration extending between location 26 and lip 28 has a greater width than height; the lip 28 is formed in this embodiment by abruptly increasing the height dimension. This lip is contoured to fit the lips of a smoker and thereby permit the filter to serve as a cigarette holder. The natural rigidty of the plug 20 readily satisfies the stiffness requirements for such a cigarette holder.

Tipping wrap 16 is wrapped securely about the plug portion upstream of the location 24 at which the taper in the plug is initiated. The tipping paper has a constant diameter throughout its axial length so that it is not tightly wrapped about the portion of filter plug 20 extending downstream from location 24. The slack between the tipping paper 16 and the plug wrap 22, which is best illustrated in FIG. 2, provides a flow path for air drawn through ventilation holes 18 in the space between the tipping paper and plug wrap. It should be noted that the ventilation holes 18 are located at or downstream of the location 24 at which the downstream taper is the filter plug dimensions is initiated.

In the particular embodiment illustrated in FIGS. 1 and 2, and corners of the rectangular configuration of lip 28 are rounded so that the tipping paper 16 is caused to conform to the short side of the rectangle while being spaced from the long side. The two (2) air passages thus produced provide undiluted flow into the mouth of the smoker with each draw or puff. At first glance, it might appear that the smoker's lips would compress tipping paper 16 against the plug wrap 22 to block air flow through the space between the tipping paper and plug wrap. However, in testing this filter arrangement, we have found that the smoker tends to relax radially compressive pressure against the filter while keeping his or her lips in close contact with the tipping paper 16. As a result, the in-rushing air through ventilation holes 18 and the space between the tipping paper and plug wrap serves to expand the space to its full extent and permit free flow of the air.

A similar embodiment is illustrated in FIGS. 3 and 4 wherein the filter plug is provided with a circular lip 30 instead of rectangular lip 28. In other words, in the embodiment of FIGS. 3 and 4, wherein like reference numerals are used for similar components shown in FIGS. 1 and 2, the same rectangular cross-section is provided between location 26 and lip 30, as is provided in the embodiment of FIGS. 1 and 2. However, instead of increasing the height dimension linearly to form lip 28, the height dimension is increased arcuately to form a generally circular lip cross-section. The diameter of lip 30 is less than the diameter of the plug wrap at the smoke receiving end of the filter and, likewise, the perimeter is also less at the smoke-discharge or discharging end. Therefore, the tipping wrap paper 16, which has a uniform diameter throughout its axial length, is arranged to conform to the portion of the filter plug upstream of location 24 but to loosely surround that portion of the filter plug disposed downstream of location 24. As best illustrated in FIG. 4, an annular passage is provided about lip 30 through which air entering the gap from ventilation holes 18 is permitted to pass into the smoker's lip, undiluted. This configuration is desirable if one wishes to hide the fact that the filter plug tapers. More particularly, the lip 30 is only slightly smaller is diameter than the tipping paper at the smoke discharge end so that the annular space between the lip 30 and the tipping paper is discernable to the smoker only upon careful examination. The functioning of the filter of FIG. 3 is, nevertheless, similar to the functioning of the filter of FIG. 1, both in terms of providing an undiluted air flow passage and in terms of providing a lip 30 serving as a contoured mouthpiece for a cigarette holder.

The filter of FIGS. 5 and 6 is similar to the filter of FIGS. 1 and 2 except that it has a lip 32 which has a square configuration. That is, all four (4) sides of the rectangular lip 32 are equal whereas only opposing sides of the rectangular lip 28 of FIG. 1 are equal. As best illustrated in FIG. 6, the square lip configuration 32 provides four (4) spaces between the lip and tipping paper 16 which permit air to flow from ventilation holes, through the space between the plug wrap 22 and tipping paper 16 and into the mouth of the smoker. The filter of FIGS. 5 and 6 functions both as a cigarette holder and to provide undiluted air flow in the same manner described above in relation to the filter of FIGS. 1 and 2.

Another filter embodiment is illustrated in FIG. 7 which differs from the filters described above only to the extent that the rectangular lip 34 does not have rounded corners. Therefore, as best illustrated in FIG. 8, the tipping paper 16 separates from the plug wrap 22 along all four (4) sides to provide four (4) distinct flow paths for the undiluted air. Two (2) short openings and two (2) long openings are provided to correspond to the difference in the lengths of the sides of lip 44.

The filters described in relation to FIGS. 1–8 provide a mouthpiece structure, in the form of lips 28, 30, 32, and 34 which serve as a cigarette holder. The inherent rigidity of the filter rod is sufficient for the filter rod to serve as the cigarette holder. In addition, the reduction in cross-sectional perimeter of the filter rods in a downstream direction provide, as described, gaps between the tipping wrap and plug wrap which permit undiluted air to enter the smoker's mouth with each puff. Moreover, the reduced cross-sectional area of the plug increases the resistance to smoke with each draw; this has been shown to improve the taste of air-ventilated cigarettes. The improved taste afforded by the filter of the present invention results from two (2) primary features of the filter. First, the air passages between the tipping wrap and the plug wrap in accordance with the present invention have greater cross-sections than air passages in prior art air dilution filters, thereby reducing the velocity of air entering the smoker's mouth with the result that the air has less effect on the taste of the smoke. Second, the reduced cross-section of the filter increases the velocity of the smoke which, as noted, enhances the smoke taste.

In all of the cases described hereinabove, the filter forms a mouthpiece which better fits the mouth of the smoker than is the case with conventional cylindrical cigarette filters. The smoker always has a clean cigarette holder with every cigarette and, since the holder is already attached to the cigarette, there is no need to transport a re-usable holder.

FIGS. 9–13 illustrate one overall method and means used to fabricate the filter elements in accordance with the present invention. Basically, this overall technique is similar in many respects to the techniques described and illustrated in detail in U.S. Pat. Nos. 3,637,447; 4,046,063; 4,075,936; and U.S. patent application Ser. No. 261,690 (referred to hereinabove), all of which are expressly incorporated herein by reference. According to the preferred embodiments of the present invention, the filtering material utilized in the production of filter elements is a continuous filamentary tow designated generally by the reference numeral 40, which includes a multiplicity of bondable fibrous members activated by contact with a hot fluid such as steam. Filtering material 40 is continuously passed into and through an elongated bonding zone 50 which includes a conventional stuffer jet 41 and steam head 42, similar in nature to those shown in the various above-mentioned prior art patents. Following the steam treatment, the resulting rod is cooled at cooling head 43 being overwrapped in garniture means 51 with a conventional plug wrap material 45. The plug wrap material 45, which is impervious to smoke, is treated with glue or adhesive 44 to assure bonding of the overwrap. Garniture 51 provides a continuous pulling mechanism which draws the rod through these initial processing stages.

Upon leaving the garniture 51, the overwrapped is subjected to water and steam treatment at water head 46, prior to deformation of the rod. The rod is deformed by means of heated crimper wheels in crimping mechanism 47, portions of which are described below in relation to FIGS. 10–13. After the rod is deformed, the rod is passed to a cooling head 48 through which it is continuously pulled by a second garniture means 52, the latter passing the crimp rod to cutter head 49. The rod is severed transversely at selected locations at cutter head 49 to provide the individual filter plugs.

All of the elements described with respect to FIG. 9 are conventional except for the heated crimp wheels in the crimper mechanism 47. These wheels are shown in detail in FIGS. 10–13 to which specific reference is now made.

Figure 12:
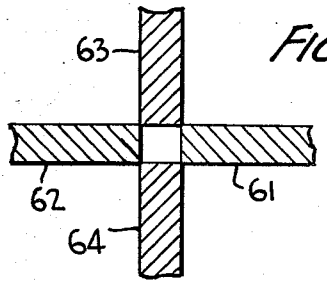
FIGS. 12 and 13 are fragmentary elevational end views in partial section of the crimping means in FIG. 11.
Figure 13:
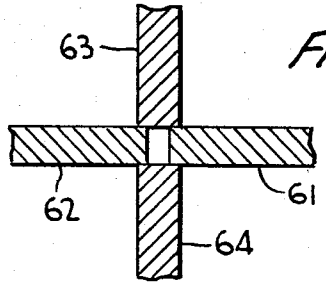
Figure 11:
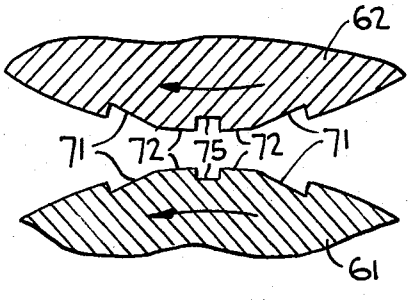
FIG. 11 is a fragmentary elevational view in partial section of the crimping means utilized in deforming the filter plug in accordance with the present invention.
Figure 10:
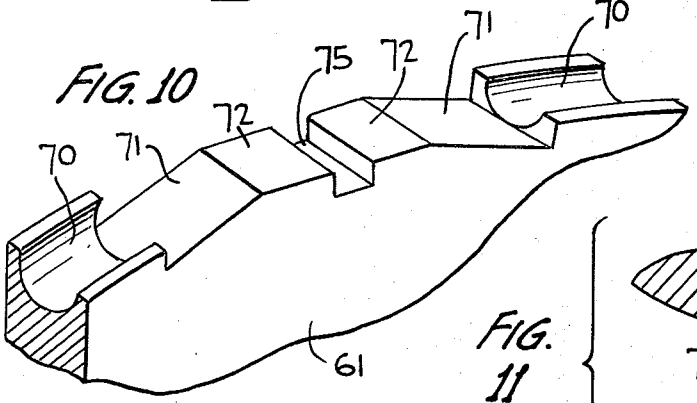
FIG. 10 is a fragmentary view in perspective showing the details of one of the crimping members employed in FIG. 9.

It should be noted that FIGS. 12 and 13 are alternative representations whereby the crimping wheels illustrated in FIG. 12 are employed to produce the square cross-sectional embodiment of FIG. 5. The crimping wheels illustrated in FIG. 13 are employed to provide the rectangular cross-section of the other embodiments. Opposed crimping wheels 61 and 62 have arcuate peripheries to permit a filter rod to pass therethrough while being crimped. Crimping recesses are defined in the arcuate periphery to achieve the deformation of the filter rod in the desired manner. Specifically, portions of the rod which are not crimped contact recessed portions 70 of wheels 61 and 62 when passing through the crimping station 47. Recessed sections 70 are partially cylindrical sections extending axially along the periphery of wheel 61 with the recesses extending radially into the wheel 61. Between successive recesses 70 the wheels 61 and 62 are contoured to form the tapered portion, the constant rectangular cross-sectional portion, and the lip portion of two (2) filters formed lip-to-lip. Specifically, a section 71 on wheel 61 registers with a similar section 71 on wheel 62 to compress the tapered portion between sections 26 and 24 of the filter plug. Two (2) additional portions 72 of wheels 61 and 62 are rotated in registration to deform the rod into the constant rectangular cross-sectioal portion. Recesses 75 are rotated into registration to define the lip portion of the filter rods. Wheels 63 and 64 in FIGS. 12 and 13 are suitably contoured to provide the taper along the height dimension sides of the filter plug cross-section.

The method and apparatus described in relation to FIGS. 9–13 assumes that the filter rod is wrapped with the plug wrap prior to deformation to achieve the desired plug cross-section. It is also possible to deform the plug prior to application of the plug wrap and then extrude the plug wrap about the deformed rod in the form of an extruded plastic film. This method is illustrated below with reference to FIGS. 14 and 15.

Figure 14:
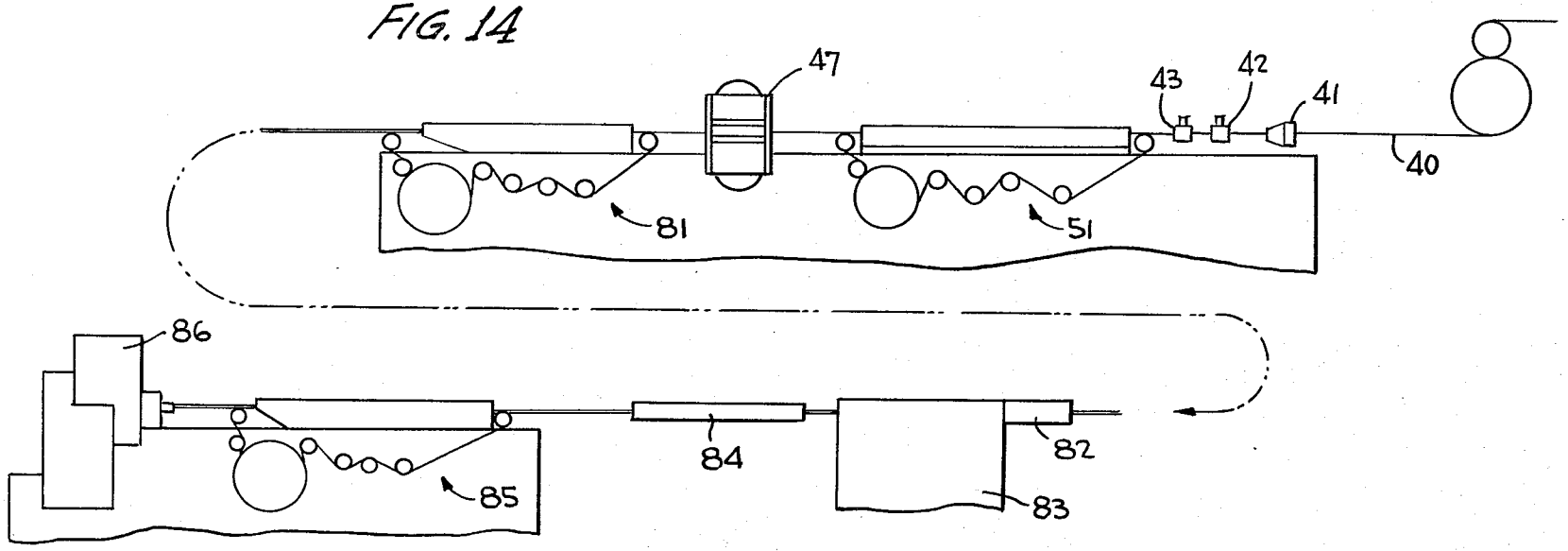
FIG. 14 is a schematic illustration of an alternative method and means for making the filter element in accordance with the present invention.

Referring specifically to FIG. 14, wherein like components of FIG. 9 are designated with the same reference numerals, the continuous filamentary tow 40 is continuously passed through a conventional stuffer jet 41 and steam head 42, following the stream treatment the resulting rod is cooled at cooling head 43 before being passed through pulling device 51. Upon leaving the pulling device 51, the unwrapped rod is passed through crimping mechanism 47 wherein it is deformed in the manner described above in relation to FIGS. 10–13 to achieve the desired configuration of the various filters illustrated in FIGS. 1–8. After the rod is deformed, it is passed through a second pulling device 81 to a vacuum chamber 82. After leaving the vacuum chamber, the rod is passed to an extruder and tube dye 83 which is described below in greater detail with reference to FIG. 15.

In the extruder and tube dye 83, a film of plastic material is extruded over the deformed filter rod so as to conform to the exact shape of the rod. Any suitable smoke-impervious plastic film may be utilized for this purpose and, in the preferred embodiment, may be polypropylene.

The wrapped rod then passes through a further water bath 84 to a third pulling device 85 before being cut into individual filter plugs at cutter head 86.

Figure 15:
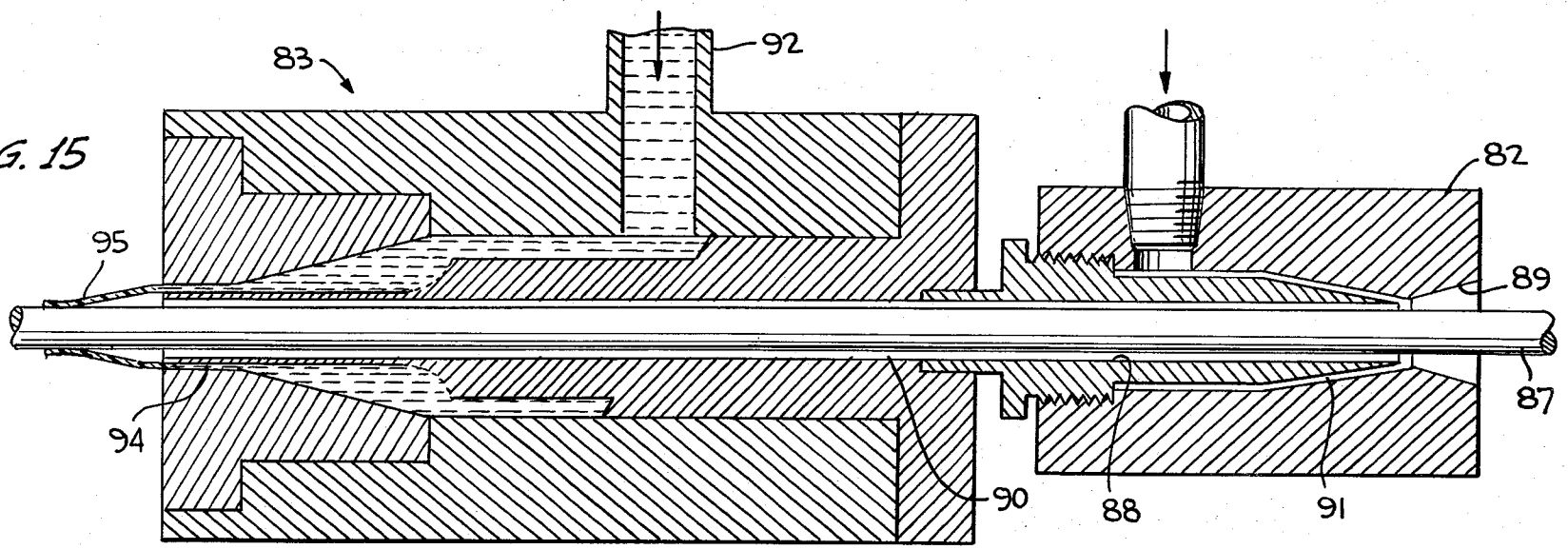
FIG. 15 is a partially schematic view in section of an extrustion apparatus for applying plug wrap to the filter rod in the method and apparatus illustrated in FIG. 14.

Referring specifically to FIG. 15, the vacuum chamber 82 is illustrated with the unwrapped rod 87 passing through a bore 88 extending longitudinally therethrough. The inlet end 89 of bore 88 is flared to provide a flow outlet which expands in the direction opposite the translation of rod 87. Bore 88 is somewhat larger in diameter than the diameter of rod 87 so that air can flow in an annular path through bore 88 in opposition to the rod movement. In order to withdraw air from bore 88, an annular nozzle is provided at the point where bore 88 begins to flare in portion 89. The annular nozzle is fed by air under pressure which aspirates air from the bore 88 and out through the flared outlet 89. As a consequence, an extremely low pressure is provided in bore 88. A portion of the vacuum chamber 82 extends into the extruder and tube dye member 83 such that bore 88 communicates coaxially with a similarly provided bore 90 in the tube dye and extruder member 83. Rod 87 passes through bore 90 which is aspirated by the annular nozzle 91 in the same manner as bore 88.

Plastic is fed into the tube dye and extruder member 83 via nozzle 92 which feeds the plastic in its molten form to an annular nozzle 94 disposed concentrically about the outlet of bore 90. The low pressure region formed around rod 87 in bore 90 causes the annular flow of plastic film from nozzle 94 to surround and conform to the rod as the rod egresses from the tube dye and extruder member 83. This plastic film 95 constitutes another form of the plug wrap 22 described above in relation to the embodiments of FIGS. 1–8.

If desired, the plastic film 95 may have incorporated therein, finely ground tobacco particles. These particles provide some exposed tobacco on the surface of the film which impart flavor to the smoke as it passes through the tobacco rod under the film. This is accomplished without any loose particle fallout from the film since the particles are solidified in place as the film solidifies about the deformed rod. Generally, the tobacco particles would constitutes one percent (1%) by weight of the molten material extruded about the rod.

The method described in relation to FIGS. 14 and 15, whereby the vacuum draws the plastic film to the exact shape of the rod and permits the smoke-impermeable film to conform to the deformed rod, is considerably cheaper than the conventional plug wrap approach described above in relation to FIG. 9. The film 95 is generally extruded to a thickness on the order of 0.5 mil but this thickness can be controlled by varying the speed ratio between the formed rod and the extruder film.

With respect to adding flavor by incorporating particles into the film, materials other than tobacco may be employed. These include carbon and magnesium hydroxide which can be compounded with a plastic resin as flavor release agents. While most thermoplastics can be utilized to extrude the film onto the deformed rod, polypropylene and cellulose acetate have proved most viable.

With respect to the filter configurations illustrated above in FIGS. 1–8, it should be understood that a variety of cross-sectional configurations can be utilized. The important aspect of the invention is that tipping paper be loosely wrapped about the smoke discharging end of the filter so that air can be drawn in with each puff through the space between the tipping wrap and the plug wrap. For some complicated cross-sectional filter plug shapes, where mechanical devices would not be adequate to press the tipping paper around the film, the tipping paper can be laminated at certain locations with heat shrinkable film. Under such circumstances, after the cigarette has been fully assembled, hot air can be blown across the cigarette to shrink the film which then draws the tipping paper around the desired locations.

Regardless of which method is employed to make the combined filter and holder described herein, the filter and holder can be made without increasing the cost of the cigarette and, in fact, the overall cost is reduced in view of the lesser amount of acetate required in the reduced filter section. By decreasing the surface area, the desired pressure drop is achieved with less filter material.

It will be apparent to those familiar with this art that there has been described and illustrated herein a smoke filter and method and means for manufacturing such filter which satisfy the various objectives set forth hereinabove and which provides significant commercial advantages. While the present invention has been described with reference to the presently preferred exemplary embodiments thereof, it should be clearly understood that the invention is not limited thereto, but may be variously practiced within the scope of the following claims.

I claim:

1. In a smoke filter element having smoke receiving and discharging ends and of the type in which a rod of smoke-pervious filter material is circumscribed with a rod wrap of smoke-impervious material which is in turn wrapped with air-impervious tipping means, an improvement wherein said tipping means peripherally engages said rod wrap for a first length of said element extending from said smoke receiving end to substantially preclude passage of smoke therebetween, said tipping means being spaced from said rod wrap along a second length of said element extending from said smoke discharging end to define a space between said rod wrap and said tipping means along said length and at said smoke discharging end, and wherein said tipping means includes ventilation holes defined therein at a location along said second length of said element for permitting air to flow into and through said space in response to suction applied at said smoke discharging end of said element.

2. The filter according to claim 1, wherein said rod wrap and said rod have a transverse cross-sectional perimeter which is smaller along the entire second length of said element than along the first length of said element, and wherein said tipping means has a cross-sectional perimeter which is substantially constant throughout the entire length of said element.

3. The smoke filter element according to claims 1 or 2, wherein said rod has a generally circular cross-sectional configuration at said smoke receiving end and a first generally rectangular cross-section at said amoke discharging end.

4. The smoke filter according to claim 3, wherein said rod in said second length of said element has a second generally rectangular cross-section which is smaller than said first generally rectangular cross-section.

5. The smoke filter element according to claim 3, wherein said first generally rectangular cross-section at said smoke discharging end is a square.

6. The smoke filter according to claim 3, wherein said rod, at said smoke discharging end of said element, has a periphery which is expanded relative to the rod periphery in the rest of said second length of said element to define a raised lip.

7. The smoke filter according to claims 1 or 2, wherein the cross-section of said rod is generally circular at said smoke-receiving end and in said first length of said element, and tapers gradually to a generally rectangular configuration in said second length of said element.

8. The element according to claim 7, wherein the cross-section of said rod at said smoke discharging end is generally rectangular and larger in one dimension than one corresponding dimension of the rectangular cross-section of the remainder of said second length of said element.

9. The element according to claim 8, wherein said rectangular rod cross-section at said smoke discharging end is substantially equal in a second dimension to a second corresponding dimension of the rectangular cross-section of the remainder of the second length of said rod element.

10. The element according to claim 7, wherein the cross-section of said rod at said smoke discharging end is generally circular with a chamber larger than one dimension of the generally rectangular cross-section of the remainder of the second length of said element.

11. The element according to claim 10, wherein the chamber of said circular rod cross-section at said smoke discharging end is substantially equal to the second dimension of the generally rectangular cross-section of the remainder of the second length of said element.

12. The element according to claim 7, wherein said rod wrap is paper.

13. The element according to claim 7, wherein said rod wrap is a plastic film extruded over the rod.

14. The element according to claim 13, wherein said film has a flavor-producing material formed therewith.

15. The element according to claim 14, wherein said flavor-producing material is finely ground tobacco.

16. The element according to claims 1 or 2, wherein said rod wrap is paper.

17. The element according to claims 1 or 2, wherein said rod wrap is a plastic film extruded over the rod.

18. The element according to claim 16, wherein said film has a flavor-producing material formed therewith.

19. The element according to claim 17, wherein said flavor-producing material is finely ground tobacco.

20. A filtered cigarette comprising in combination a tobacco rod and a filter element as defined in claims 1 or 2 secured in end-to-end relationship.

21. A smoke filter element comprising:

a rod of smoke-pervious filter material having first and second ends;

a rod wrap of smoke-impervious material circumscribing said rod between said first and second ends;

tipping paper of air-pervious material surrounding said rod wrap;

wherein said tipping paper is tightly wrapped about the periphery of said rod wrap along a first length of said rod extending from said first end to a predetermined location between said first and second ends;

wherein said tipping paper is loosely wrapped about the periphery of said rod wrap along a second length of said rod extending from said second end to said predetermined location; and wherein said tipping paper has ventilation holes therein providing flow communication between ambient air and space between said tipping paper and said rod wrap along said second end of said rod.

22. A smoke filter for filtering undesirable constituents from smoke and including a filter element having a smoke receiving end and a smoke discharging end and further comprising:

an axially-elongated rod of filter material having a peripheral contour which changes between said smoke receiving and smoke discharging ends and having a transverse cross-section with a predetermined perimeter at said smoke receiving end and a smaller perimeter at the smoke discharging end and throughout an axially-extending reduced rod section between said smoke discharging end and a specified location along the rod length;

smoke-impervious rod wrap means extending longitudinally of and circumscribing said rod and conforming to the peripheral contour of the rod along the entire rod length; and tipping means extending longitudinally of and circumscribing said rod wrap means, said tipping means being tightly circumscribed about said rod wrap means at said smoke receiving end and for a specified longitudinal distance therefrom, but loosely wrapped about said rod wrap means along said reduced rod section to provide at least one continuous flow gap between said tipping wrap means and said rod wrap means along said reduced rod section, said tipping means being made of material which is impervious to air and having ventilation holes defined therethrough at a longitudinal location along said reduced rod section.

* * * * *